US005760759A

United States Patent [19]

Tanaka et al.

[11] Patent Number: 5,760,759

[45] Date of Patent: Jun. 2, 1998

[54] LIQUID CRYSTAL DISPLAY

[75] Inventors: Toshihiko Tanaka; Shoji Iwasaki, both of Tottori; Masahiro Nakamura, Tottori-Ken; Kouji Maeta; Jouji Yamada, both of Tottori, all of Japan

[73] Assignees: Sanyo Electric Co., Ltd., Moriguchi; Tottori Sanyo Electric Co., Ltd., Tottori, both of Japan

[21] Appl. No.: 553,868

[22] Filed: Nov. 6, 1995

[30] Foreign Application Priority Data

| | | | |
|---|---|---|---|
| Nov. 8, 1994 | [JP] | Japan | 6-273803 |
| Nov. 14, 1994 | [JP] | Japan | 6-279223 |
| Apr. 11, 1995 | [JP] | Japan | 7-085434 |
| Aug. 31, 1995 | [JP] | Japan | 7-224389 |

[51] Int. Cl.[6] ..... G09G 3/36

[52] U.S. Cl. ..... 345/95; 345/210; 345/211

[58] Field of Search ..... 345/94, 95, 96, 345/99, 87, 210, 208, 209, 211, 50–54; 349/33, 34, 37

[56] References Cited

U.S. PATENT DOCUMENTS

| | | | |
|---|---|---|---|
| 4,769,639 | 9/1988 | Kawamura et al. | 345/95 |
| 5,101,116 | 3/1992 | Morokawa | 345/95 |
| 5,111,319 | 5/1992 | Morris | 345/95 |
| 5,459,481 | 10/1995 | Tanaka et al. | 345/95 |
| 5,510,814 | 4/1996 | Ise | 345/95 |

FOREIGN PATENT DOCUMENTS

| | | |
|---|---|---|
| 57-15393 | 3/1982 | Japan . |
| 57-38497 | 3/1982 | Japan . |
| 57-57718 | 12/1982 | Japan . |
| 61-41190 | 2/1986 | Japan . |
| 63-304228 | 12/1988 | Japan . |
| 3-2394 | 1/1991 | Japan . |
| 4-97218 | 3/1992 | Japan . |
| 5-35217 | 2/1993 | Japan . |

*Primary Examiner*—Dennis Doon Chow

*Attorney, Agent, or Firm*—Nikaido, Marmelstein, Murray & Oram LLP

[57] ABSTRACT

A driving power supply and a driving circuit are provided which are suitable for use in a high resolution matrix liquid crystal display. A power source circuit generates two selecting potentials and an intermediate potential between the selecting potentials to be supplied to scanning electrodes through a scanning circuit, two potentials close to the intermediate potential to be supplied to signal electrodes through a signal circuit, and potentials for driving the scanning circuit and the signal circuit. A receiving circuit controls the scanning circuit and the signal circuit based on control signals and an image signal and monitors the potential of the power supplied to the liquid crystal display to start the potential generation by the power source circuit when the potential has sufficiently increased.

19 Claims, 13 Drawing Sheets

4

LIQUID CRYSTAL DISPLAY

BACKGROUND OF THE INVENTION

1. Field of the Invention

The present invention relates to a liquid crystal display, and more specifically, to driving voltages and driving circuits or a matrix liquid crystal display.

2. Description of the Prior Art

A matrix liquid crystal display is known in which a group of stripe-shaped scanning electrodes and a group of stripe-shaped signal electrodes are arranged to be perpendicular to each other with a liquid crystal layer therebetween. Elements of the liquid crystal cell at the crossing points of the scanning and the signal electrodes are called pixels. By selecting appropriate pixels and causing a potential difference enough to change the orientation of liquid crystal between the scanning and the signal electrodes of the selected pixels, a desired image is displayed on the liquid crystal cell. Pixels are referred to as selected pixels when the orientation of their liquid crystal is changed, and as non-selected pixels when the orientation of their liquid crystal is not changed. To select a pixel it is necessary to apply an effective voltage greater than the threshold voltage for causing a change in the orientation of the liquid crystal. A line sequential scanning is performed in selecting pixels in the matrix liquid crystal display device. Since the liquid crystal cell deteriorates if a direct current is continuously applied thereto, generally, the polarity of the applied voltage is inverted as shown in Japanese Published Patent Application S57-57718.

The line sequential scanning is performed conventionally in the following manner: Six potentials VL, Vb1, Vb2, Vb3, Vb4 and VH to be applied to the scanning electrodes and the signal electrodes are set in the order of VL<Vb1<Vb2<Vb3<Vb4<VH. The lowest potential VL and the highest potential VH are called selecting potentials. The selecting potential VL is applied to one of the scanning electrodes while the potential Vb4 is being applied to all the other scanning electrodes, and the scanning electrode to which the selecting potential VL is applied is changed sequentially. Thus the liquid crystal cell is scanned. During the scanning, the selecting potential VH or the potential Vb3 is applied to the signal electrodes according to whether the pixels on the scanning electrode to which the selecting potential VL is being applied are to be selected or not.

After the above mentioned scanning, the selecting potential VH is used instead of the selecting potential VL and the potential Vb1 is used instead of the potential Vb4 for applying to the scanning electrodes, and the liquid crystal cell is scanned. During the scanning, the selecting potential VL or the potential Vb2 is applied to the signal electrodes according to whether the pixels on the scanning electrode to which the selecting potential VH is applied are to be selected or not. Therefore, the polarity of the voltage applied in this scanning is opposite to that in the previous scanning. After this scan, another scan is performed with the polarity inverted again.

One scan is time-divided according to the number of the scanning electrodes, and the effective potential difference between the scanning electrodes and the signal electrodes is dependent on the number of the scanning electrodes, that is, the number of time division. The potentials are so set that only those pixels to which the selecting potential VH and the selecting potential VL are applied at the same time are selected, with the number of time division taken into consideration. Accordingly, the pixel whose scanning electrode is supplied with the selecting potential VL and whose signal electrode is supplied with the selecting potential VH and the pixel whose scanning electrode is supplied with the selecting potential VH and whose signal electrode is supplied with the selecting potential VL are selected.

Thus, by inverting the polarity of the applied voltage in the scanning, the pixels where the orientation of the liquid crystal is to be changed are selected while preventing the deterioration of the liquid crystal. Light is transmitted or intercepted according to the orientation of the liquid crystal, and a desired image is displayed on the liquid crystal cell.

The maximum voltage applied between the scanning electrode and the signal electrode is referred to as a selecting voltage. In the example mentioned above, the difference between the selecting potentials VH and VL is the selecting voltage. The selecting voltage may be as low as several volts when the number of scanning electrodes is 3 to 4. Thus, this method is easily carried out simply by preparing an integrated circuit capable of handling a voltage of approximately 10 volts for driving the scanning and signal electrodes. However, when the number of time division increases with an increase in the number of the scanning electrodes, a high selecting voltage is required to ensure an effective value for the application voltage. For example, at 1/200 duty where 200 scanning electrodes are used, a selecting voltage of 20 to 35 volts are required. If such a voltage is applied to the electrodes of the liquid crystal cell in the above-described manner, a great capacitive load current attributed to the liquid crystal will flow when the polarity of application voltage is inverted, so that the power consumption will increase.

In recent years, there have been demands for high resolution color liquid crystal display devices and a 1024RGB×768 pixel (color XGA) display device has been replacing a 640×480 pixel (VGA) black and white display device to become a standard. In the former color display device, the number of pixels per signal electrode is 3072 and the total number of pixels is nearly ten times that of the latter display device. Accordingly, it is necessary to reduce various processing times such as data transfer time. For this reason, an integrated circuit having a high withstand voltage and a high processing speed is needed as a liquid crystal display device driving circuit. For integrated circuits, however, a high withstand voltage and a high processing speed contradict each other. It is therefore difficult to realize an integrated circuit having both of these characteristics.

In addition, if a comparatively high selecting voltage is supplied to an integrated circuit to apply the voltage to the electrodes when the driving voltage of the circuit is not stably supplied, the image displayed on the liquid crystal cell will be of low quality, the liquid crystal cell will deteriorate and the integrated circuit will be damaged.

Therefore, the applicant of the present invention developed a driving method where the potential difference between the selecting potentials applied to the scanning electrodes is doubled compared to the conventional method and the difference between the two potentials applied to the signal electrodes is reduced in order to realize a liquid crystal display capable of driving at a high speed. As a result, a signal circuit for applying the potentials to the signal electrodes is suitable for a high speed driving. However, some problems were revealed to be solved in handling the selecting potentials with such a large difference and in handling some control signals in a scanning circuit for applying the selecting potentials to the scanning electrodes.

SUMMARY OF THE INVENTION

An object of the present invention is to provide a driving power supply and a driving circuit suitable for use in a high resolution matrix liquid crystal display, and more specifically, to provide a scanning circuit and a power source circuit for a liquid crystal display which uses selecting potentials of a large difference.

To achieve the above-mentioned object, according to the present invention, in a liquid crystal display where two selecting potentials with a large potential difference are applied to scanning electrodes and potentials substantially at the midpoint of the selecting potentials are applied to signal electrodes, the potentials are set according to the voltage averaging method, and supply of the selecting potentials to a scanning circuit which applies them to the scanning electrodes is started after the voltage of a driving power increases beyond a predetermined value. An intermediate potential which is substantially at the midpoint of the selecting potentials is applied to the scanning electrodes other than the one to which the selecting potential is applied. The potentials to be applied to the scanning electrodes and to the signal electrodes are generated by a power source circuit. The power source circuit short-circuits the two selecting potentials when the voltage of the primary electric power being supplied decreases below a predetermined value. The primary electric power supplied to the power source circuit may comprise only a pair of potentials.

Display on the liquid crystal cell is initiated after the driving power of the scanning circuit has become stable. For this purpose, a display control signal of two potential levels provided by an information processing apparatus incorporating the liquid crystal display is held at the low level until the voltage of the driving power of the scanning circuit increases to a predetermined value or until a predetermined period of time elapses after the driving power is supplied. Then the level of the display control signal from the information processing apparatus is transmitted to the scanning circuit.

The scanning circuit includes a liquid crystal driver for selecting and outputting potentials to the scanning electrodes and a logic portion for controlling the operation of the liquid crystal driver. The selecting potentials are supplied only to the liquid crystal driver.

With these features, the scanning circuit operates stably and the scanning circuit and the liquid crystal cell are secured. Images are surely displayed and an image of a good quality with a high contrast is presented immediately after the display is initiated.

BRIEF DESCRIPTION OF THE DRAWINGS

This and other objects and features of this invention will become clear from the following description, taken in conjunction with the preferred embodiments with reference to the accompanied drawings in which:

FIG. 6 shows relationships between the application potentials and pixel selection in the liquid crystal display of the present invention;

DESCRIPTION OF THE PREFERRED EMBODIMENTS

Figure 1:
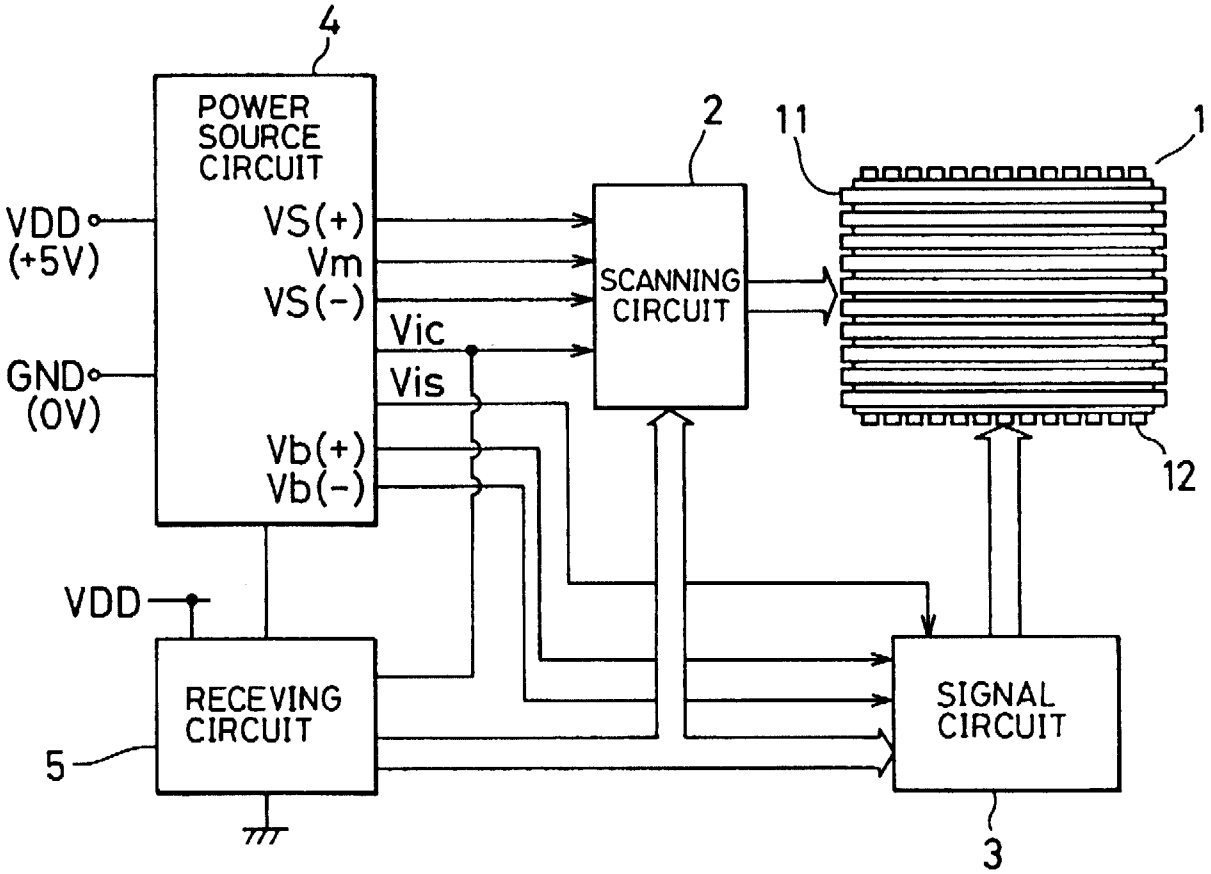
FIG. 1 shows the structure of a liquid crystal display of the present invention.

Referring to FIG. 1, there is schematically shown the general structure of a liquid crystal display of the present invention. Reference numeral 1 represents a liquid crystal cell. Reference numeral 2 represents a scanning circuit. Reference numeral 3 represents a signal circuit. Reference numeral 4 represents a power source circuit. Reference numeral 5 represents a receiving circuit which processes image signals and control signals transmitted from an information processing apparatus, e.g. personal computer, incorporating the liquid crystal display and produces an output.

The liquid crystal cell 1 is comprised of field effect liquid crystal such as super twisted nematic liquid crystal. The liquid crystal cell 1 is driven according to the voltage averaging method. The liquid crystal cell 1 includes a group of stripe-shaped transparent scanning electrodes 11 arranged parallel to each other on one surface a liquid crystal layer and a group of stripe-shaped transparent signal electrodes 12 arranged parallel to each other on the other surface of the liquid crystal layer. The scanning electrodes 11 and the signal electrodes 12 are in the directions perpendicular to each other. The scanning electrodes 11 and the signal electrodes 12 arranged opposite with the liquid crystal layer therebetween form pixels at the crossing points. No active element is provided to each crossing point and the liquid crystal cell 1 is a so-called simple matrix.

The scanning circuit 2 supplies the scanning electrodes 11 of the liquid crystal cell 1 with scanning potentials. The signal circuit 3 supplies the signal electrodes 12 of the liquid crystal cell 1 with signal potentials in accordance with image signals. These circuits are arranged at sides of the liquid crystal cell 1. In order that the size of the liquid crystal display does not increase, integrated circuits are used as the scanning circuit 2 and the signal circuit 3. The scanning circuit 2 supplies the scanning electrodes 11 with positive and negative selecting potentials VS(+) and VS(−) and a potential Vm intermediate therebetween. The signal circuit 3 supplies the signal electrodes 12 with positive and negative bias potentials Vb(+) and Vb(−) which are close to an intermediate value between the positive and negative selecting potentials VS(+) and VS(−). Here, the signs of the potentials are not in the absolute meaning based on the ground potential but are relative with respect to the intermediate potential Vm.

In the present invention, the line sequential scanning is performed. One scan is referred to as a frame here, and examples will be shown where the positive selecting potential VS(+) and the negative selecting potential VS(−) are alternately used in every other frame, for simplifying the explanation. The intermediate potential Vm is applied to the scanning electrodes other than the electrode to which the selecting potentials VS(+) and VS(−) are applied. A signal to instruct to invert the polarity of the application voltage will be referred to as an alternating signal. The alternating signal is a signal in which potentials of a high level and a low level alternately occur every frame.

The potentials to be applied to the scanning electrodes 11 and to the signal electrodes 12 mentioned above are in the order of VS(−)<Vb(−)<Vm<Vb(+)<VS(+). The selecting voltage is defined as the combination of the positive selecting potential VS(+) and the negative bias potential Vb(−), and the combination of the negative selecting potential VS(−) and the positive bias potential Vb(+). An effective applied voltage higher than a threshold voltage Vth of the liquid crystal cell 1 is attained by applying the selecting potential VS(−) to the scanning electrode 11 and the bias potential Vb(+) to the signal electrode 12 or by applying the selecting potential VS(+) to the scanning electrode 11 and the bias potential Vb(−) to the signal electrode 12.

Figure 2:
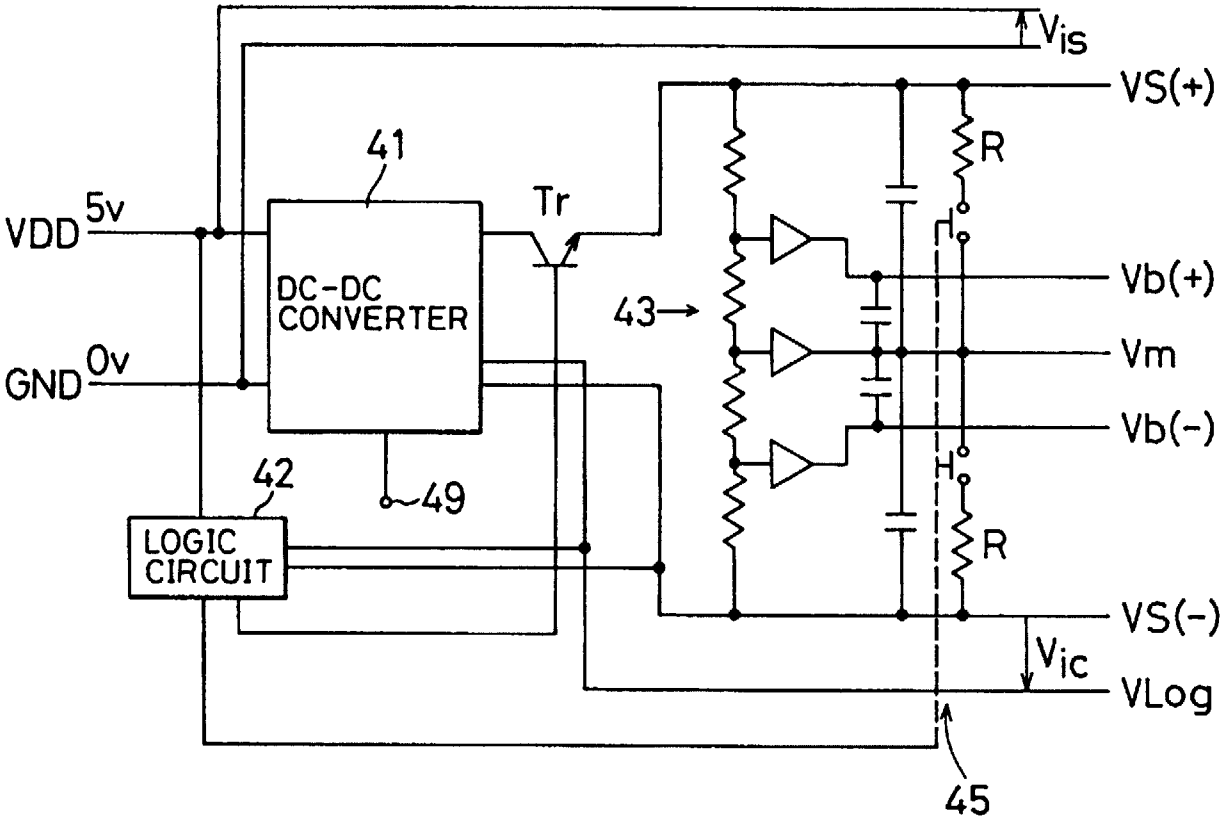
FIG. 2 shows the structure of a power source circuit of a first embodiment of the present invention.

Embodiments of the liquid crystal display of the present invention thus structured will be described with reference to the drawings. Referring to FIG. 2, there is shown the structure of the power source circuit 4 of a first embodiment. The power source circuit 4 is provided with a DC—DC converter 41 and a resistance dividing circuit 43. The power source circuit 4 is supplied with a pair of potentials, a ground potential (0 volt) and a potential VDD of 5 volts, as the primary power supply by the previously mentioned information processing apparatus. The DC—DC converter 41 is instructed to start and stop generation of potentials by a signal provided by the receiving circuit 5 through a terminal 49. The scanning circuit 2 and the signal circuit 3 are both set to be driven by a voltage of 5 volts. The power source circuit 4 supplies a voltage Vic for driving the scanning circuit 2 and a voltage Vis for driving the signal circuit 3.

Figure 4:
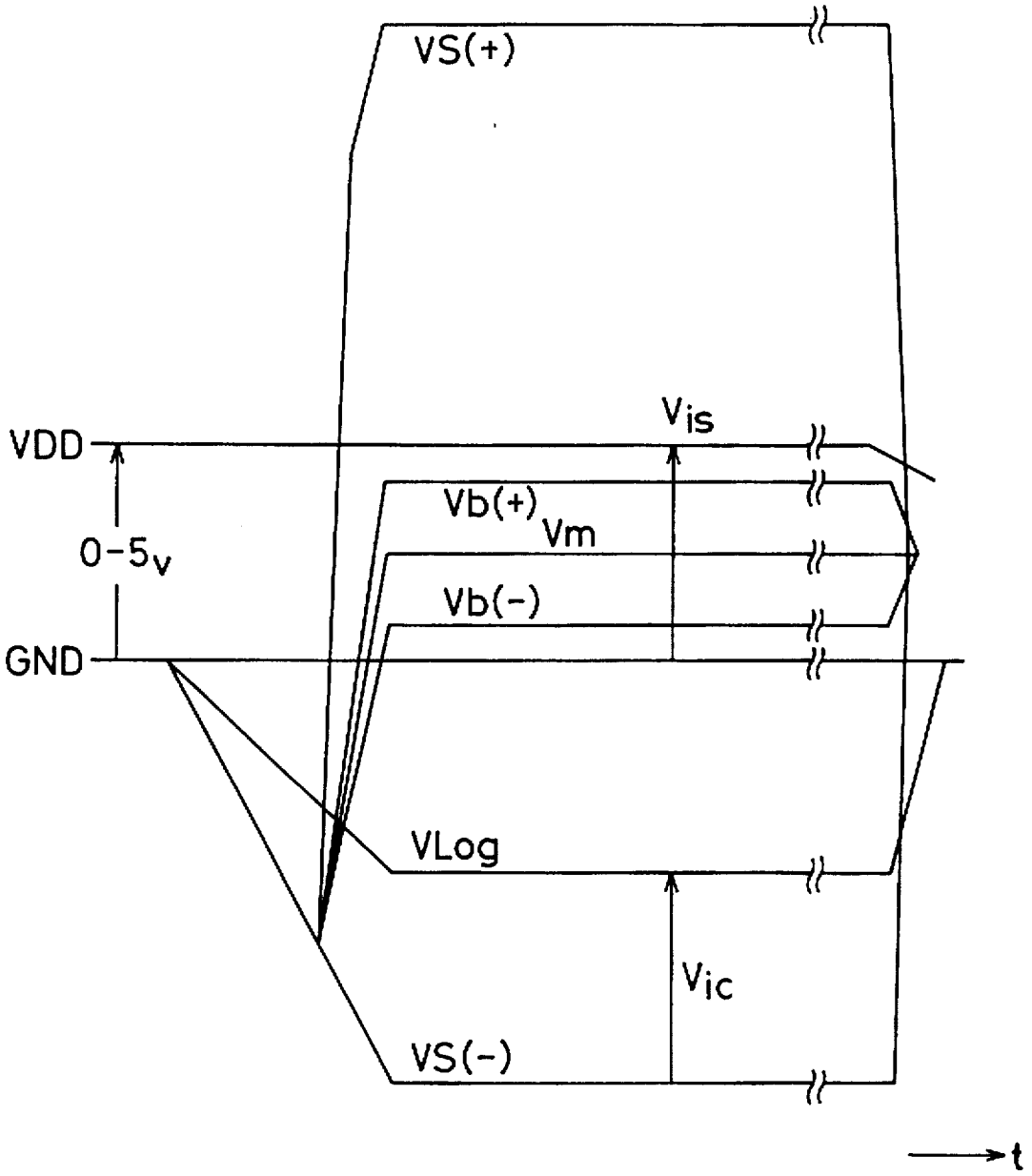
FIG. 4 shows application potentials and driving potentials generated by the power source circuit of the first embodiment.

Referring to FIG. 4, there is shown a relationship among these potentials. To the signal circuit 3, the 0-volt and 5-volt primary power supply potentials are supplied as the driving voltage Vis. The other potentials are generated by a switching control of the 0-volt primary power supply potential. In this embodiment, the positive selecting potential VS(+) is set to +32.5 volts and the negative selecting potential VS(−) is set to −27.5 volts. The intermediate potential Vm is 2.5 volts, which is an intermediate value between the two primary power supply potentials and equals the median between the positive and negative selecting potentials VS(+) and VS(−). The power source circuit 4 also generates a potential VLog which is higher than the negative selecting potential VS(−) by 5 volts. The potential VLog is supplied to the scanning circuit 2 and used as the driving voltage Vic in combination with the selecting potential VS(−).

It is effective and desirable that, when only one pair of primary power supply potentials are supplied, a potential substantially intermediate between the primary power supply potentials be set as the intermediate potential Vm and the selecting potentials be generated from one of the primary power supply potentials as described above. To obtain stable potentials, it is particularly desirable that the selecting potentials be generated by use of the 0-volt power supply potential. The values of the selecting voltage and bias voltage are set according to the voltage averaging method. For example, in the case of a driving at 1/240 duty, the optimum bias value is 1:16.5, and when the selecting voltages is 30 volts, the bias potentials Vb(+) and Vb(−) are 4.3 volts and 0.7 volts, respectively.

Figure 3:
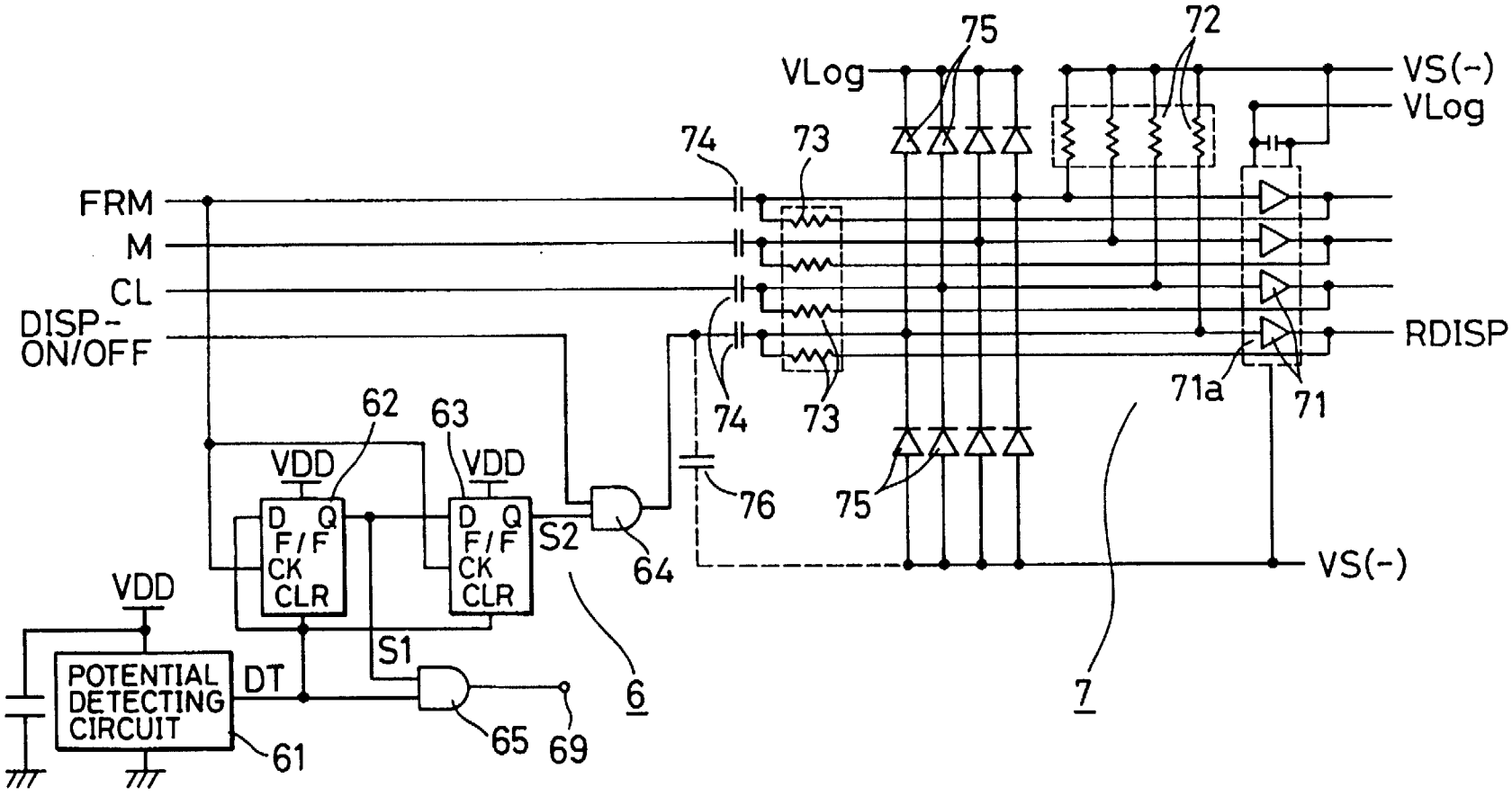
FIG. 3 shows relevant portions the structure of a receiving circuit of the first embodiment.

Referring to FIG. 3, there is shown relevant portions of the structure of the receiving circuit 5. The receiving circuit 5 is provided with a buffer circuit (not shown) corresponding to the image signal, an initializing circuit 6 for adjusting the display initiation period of the liquid crystal cell 1 and a potential converting circuit 7 for converting the potentials of the control signals supplied to the scanning circuit 2 as shown in FIG. 3.

The initializing circuit 6 is provided with a potential detecting circuit 61 which detects that the supplied voltage VDD exceeds a predetermined value, 3 volts in this embodiment, two flip-flops 62 and 63, and two AND gates 64 and 65. An output signal DT of the potential detecting circuit 61 is supplied to a data input terminal D and a clear terminal CLR of the first stage flip-flop 62, a clear terminal CLR of the second stage flip-flop 63 and one of the input terminals of the AND gate 65. To clock terminals CK of the flip-flops 62 and 63, a frame signal FRM corresponding to the frame of an image to be displayed is inputted.

An output signal S1 of the first stage flip-flop 62 is supplied to the other input terminal of the AND gate 65. The output terminal 69 of the AND gate 65 is connected to the terminal 49 of the DC—DC converter 41 in the power source circuit 4 so that an output of the AND gate 65 is used as the signal to instruct the start and stop of the operation of the DC—DC converter 41. Consequently, the DC—DC converter 41 starts to generate the potentials when the frame signal FRM from the information processing apparatus is detected for the first time after the power supply to the liquid crystal display is started and becomes 3 volts or higher.

The output signal S1 of the first stage flip-flop 62 is also inputted to the data input terminal D of the second stage flip-flop 63. An output signal S2 of the second stage flip-flop 63 is supplied to one of the input terminals of the AND gate 64. To the other input terminal of the AND gate 64, a DISP-ON/OFF signal from the information processing apparatus is inputted. The DISP-ON/OFF signal comprises a high level potential and a low level potential. The transition from the low level to the high level indicates a initiation of display and the transition from the high level to the low level indicates a termination of display. The DISP-ON/OFF signal is at the low level before the initiation of display and is at the high level from the initiation of display till the termination of display. The AND gate 64 outputs the inputted DISP-ON/OFF signal and the output signal is held at a low level until the power supply to the liquid crystal display is started and reaches 3 volts. After the power supply voltage has become 3 volts or higher, the level of the inputted DISP-ON/OFF signal is reflected in the level of the output signal.

In this arrangement, it is not until the power supply to the liquid crystal display is started and becomes 3 volts or higher that the DC—DC converter 41 is activated to start the supply of the driving voltage Vic and the potentials VS(+), VS(−) and Vm to the scanning circuit 2. Thereafter, with a delay of at least one frame, the level transition of the DISP-ON/OFF signal from the low level to the high level is transmitted to the scanning circuit 2. Consequently, the scanning circuit 2 receives the instruction to initiate the display when its operation is stabilized, and it never fails to detect the instruction nor applies undesirable voltage to the liquid crystal cell 1 before the initiation of display. The output signal of the AND gate 64 is also supplied to the signal circuit 3, though not shown. For this reason, the signal circuit 3 also operates correctly. When the primary power supply is provided to the signal circuit 3 as shown in FIG. 2, the DISP-ON/OFF signal may not be provided by way of the AND gate 64 but directly to the signal circuit 3, since the signal circuit 3 is already operating stably when the DISP-ON/OFF signal is outputted from the information processing apparatus.

The potential converting circuit 7 receives control signals through AC coupling and converts the potentials of the signals to transmit them to the scanning circuit 2. Thereby, the scanning circuit 2 is protected from excessive voltages. Specifically, an AC coupling capacitor 74, a resistor 72 and a feedback resistor 73 are connected to an operational amplifier 71, and the operational amplifier 71 is used as a comparator which compares an input potential with a predetermined potential and holds the output potential until the comparison result changes. In addition, in order to protect the operational amplifier 71 from excessive voltages, a constant voltage conducting element 75 such as a Zener diode or a Schottky barrier diode is arranged between an input terminal 71*a* and the electrical connection to supply the potentials VS(−) and VLog which constitute the driving voltage Vic for the operational amplifier 71*a*. The resistor 72 and the capacitor 74 constitute a differentiating circuit, and the resistor 72 is used also as a differential constant setting resistor.

As shown by the dotted line in FIG. 3, the output terminal of the AND gate 64 which outputs the DISP-ON/OFF signal may preferably be coupled to the negative selecting potential VS(−) through a capacitor 76. In the arrangement provided with the capacitor 76, the low potential (the potential immediately after the initialization) of a signal RDISP produced by converting the potential of the DISP-ON/OFF signal is held at the negative selecting potential VS(−), so that the DISP-ON/OFF signal is surely initialized. It is effective that the capacity of the capacitor 76 is 56 to 2000pF.

In the potential converting circuit 7 thus structured, the point of change of the supplied control signal is extracted by the capacitor 74 and the differentiation output is inputted to the operational amplifier 7 which outputs it after converting it to a signal potential in accordance with the driving power supply potential of the scanning circuit 2. In particular, since the number of signals supplied to the scanning circuit 2 is smaller than the number of signals supplied to the signal circuit 3, the number of circuit elements for the potential conversion may be small compared to the case in which the signals supplied to the signal circuit 3 are potential-converted.

The driving voltage for the potential converting circuit 7 is supplied by the DC—DC converter 41. For this reason, the operation of the potential converting circuit 7 is unstable until the output of the DC—DC converter 41 stabilizes after the activation of the liquid crystal display, so that the signals supplied during this period may not be processed correctly. For example, with respect to a signal in which the potential is usually held at a constant level like the DISP-ON/OFF signal, it would be impossible to extract the point of change of the signal through capacitor coupling, and the potential converting circuit 7 might fail to detect the point of change of the signal. If the circuit 7 fails to detect the transition of the signal from the low level to the high level instructing the initiation of display, the DISP-ON/OFF signal is held at the high level thereafter, so that the instruction to initiate display cannot be detected even after the output of the DC—DC converter 41 stabilizes and the DISP-ON/OFF signal supplied to the scanning circuit 2 becomes meaningless.

However, in the receiving circuit 5 of this embodiment, as described previously, the initializing circuit 6 holds the DISP-ON/OFF signal at the low level until the potential converting circuit 7 starts to operate correctly after the activation of the liquid crystal display. The problem that display is not presented although display is requested is certainly prevented.

Figure 5:
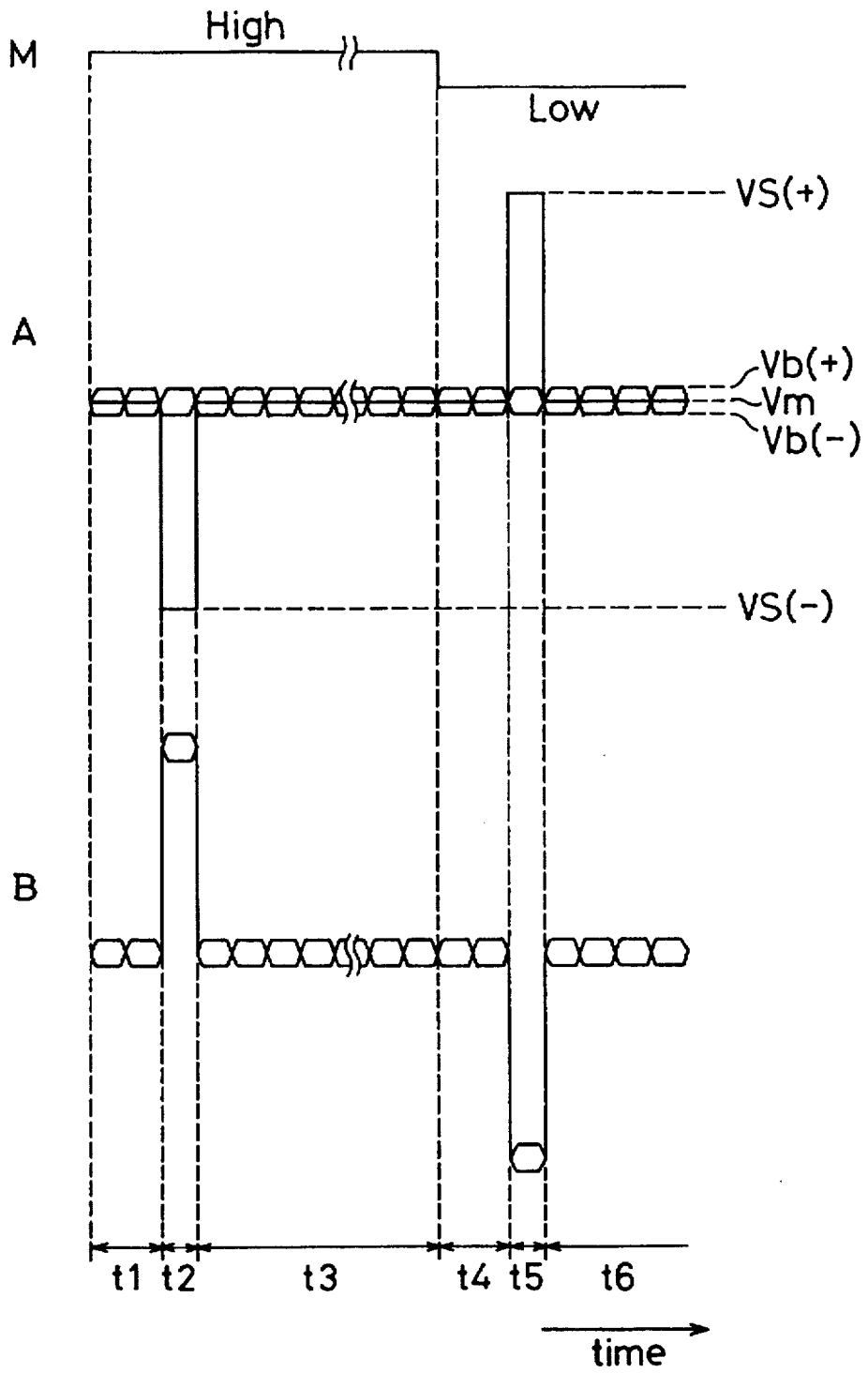
FIG. 5 shows variations in application potentials in the liquid crystal display of the present invention.
Figures 1, 6A:
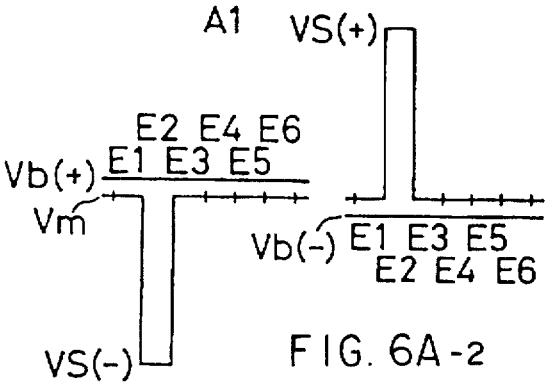
Figures 1, 6B:
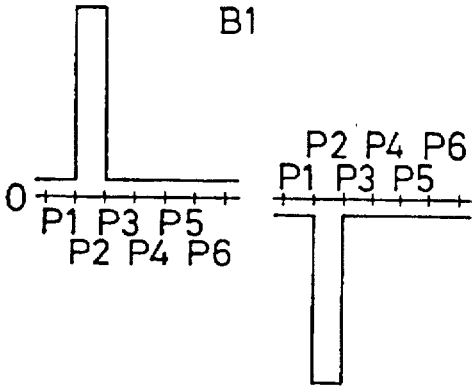
Figures 2, 6A:
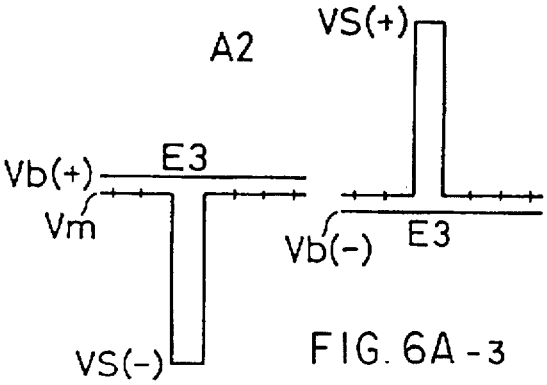
Figures 2, 6B:
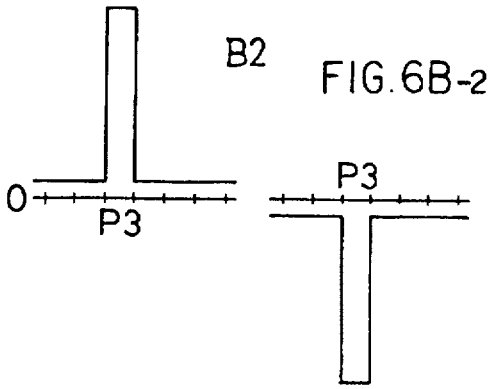
Figures 3, 6A:
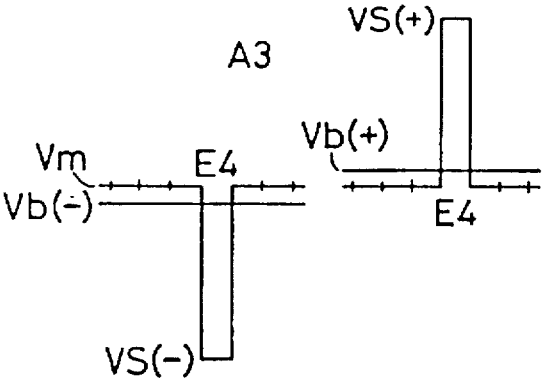
Figures 3, 6B:
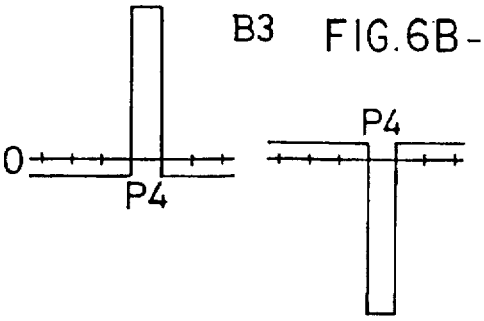

Referring to FIGS. 5 and 6, there are shown relationships among the potentials VS(+), VS(−) and Vm supplied to the scanning electrodes 11, the potentials Vb(+) and Vb(−) supplied to the signal electrodes 12 and the voltage applied to the liquid crystal cell 1. FIG. 5 shows variations of the potentials applied to the scanning electrode and the signal electrode corresponding to one pixel (A) and of the potential difference between them (B) in the process of time. Here, the polarity is inverted every frame to simplify the explanation. Periods t1 to t3 correspond to a scanning for one frame and periods t4 to t6 correspond to another scanning for the next frame. The signal M is the alternating signal which instructs the inversion of the polarity of the voltage applied to the liquid crystal cell 1. The level of the signal M changes every frame.

Whether the positive selecting potential VS(+) or the negative selecting potential VS(−) is supplied to the scanning electrodes depends on the level of the alternating signal M. In this example, the negative selecting potential VS(−) is supplied when the alternating signal M is at the high level. During the period t2 in the first frame, the selecting potential VS(−) is supplied to the scanning electrode, and during the period t5 in the second frame, the selecting potential VS(+) is supplied to the scanning electrode. During the periods t1, t3, t4 and t6, the selecting potentials are supplied to other scanning electrodes and the intermediate potential Vm is supplied to this scanning electrode.

Whether the positive bias potential Vb(+) or the negative bias potential Vb(−) is supplied to the signal electrodes 12 depends on the level of the alternating signal M and on whether the pixel is to be selected or not. When the pixel is to be selected in the first frame, the bias potential Vb(+) is supplied during the period t2, and when the pixel is not to be selected, the bias potential Vb(−) is supplied during the period t2. When the pixel is to be selected in the second frame, the bias potential Vb(−) is supplied during the period t5, and when the pixel is not to be selected, the bias potential Vb(+) is supplied during the period t5. Though the effective application voltage is not shown in the figure, the effective voltage applied to this pixel exceeds the threshold voltage Vth when the bias potential Vb(+) is applied to the signal electrode in the period t2. Similarly, the effective voltage exceeds the threshold voltage Vth when the bias potential Vb(−) is applied in the period t5.

FIG. 6 shows potentials applied to adjoining six scanning electrodes E1 to E6 and one signal electrode (A1 to A3) and the potential differences (B1 to B3). Reference symbols P1 to P6 show pixels at the prossing points of the scanning electrodes E1 to E6 and the signal electrode, respectively. A1 and B1 show a case in which the selecting potential is being supplied to the scanning electrode E2. A2 and B2 show a case in which the selecting potential is being supplied to the scanning electrode E3. A3 and B3 show a case in which the selecting potential is being supplied to the scanning electrode E4. In this example, the pixels P2 and P3 corresponding to the scanning electrodes E2 and E3 are selected pixels and the pixel P4 corresponding to the scanning electrode E4 is a non-selected pixel.

As described previously, the scanning electrode is supplied with the selecting potentials VS(+) and VS(−) alternately every frame. Since the pixel P2 is a selected pixel, as shown at A1, the positive bias potential Vb(+) is supplied to the signal electrode when the negative selecting potential VS(−) is supplied to the scanning electrode E2, and the negative bias potential Vb(−) is supplied to the signal electrode when the positive selecting potential VS(+) is supplied to the scanning electrode E2. Likewise, since the pixel P3 is a selected pixel, as shown at A2, the bias potential Vb(+) or Vb(−) is supplied to the signal electrode according to the selecting potential VS(−) or VS(+) supplied to the scanning electrode E3. Consequently, the effective voltages applied to the pixels P2 and P3 exceed the threshold voltage Vth, so that the orientation of liquid crystal changes at these pixels. On the other hand, since the pixel P4 is not to be selected, as shown at A3, the negative bias potential Vb(−) is supplied to the signal electrode when the negative selecting potential VS(−) is supplied to the scanning electrode E4, and the positive bias potential Vb(+) is supplied to the signal electrode when the positive selecting potential VS(+) is supplied to the scanning electrode E4. Consequently, the effective voltage applied to the pixel P4 does not reach the threshold voltage Vth, so that no change appears in the orientation of liquid crystal at this pixel.

In order to supply the scanning electrodes 11 with the positive selecting potential VS(+) and the negative selecting potential VS(−), a withstand voltage substantially twice that of the prior art is required for the output stage of the integrated circuit of the scanning circuit 2. However, since the processing performed by the scanning circuit 2 is a low speed processing in accordance with the number of scanning lines and the changeover from one selecting potential to the other is made by way of the intermediate potential Vm, the great capacitive load current attributed to the liquid crystal does not flow in the changeover of the selecting potential. In addition, the waveform hardly collapses. This is a cause of crosstalk and apt to occur in the prior art. On the other hand, the signal circuit 3, which is driven by a voltage as low as 5 volts, is not only suitable for high speed driving but also suitable for the arrangement at a side of the liquid crystal cell 1, since it occupies only a small area.

Further, the liquid crystal display of this embodiment is characterized by the relationship between the driving voltage of the signal circuit 3 and the bias potentials. Specifically, the greater the number of time division is, the greater the voltage margin is to facilitate the driving. For example, in the case of a driving at 1/240 duty, since the potentials of the driving voltage Vis are 5 volts and 0 volt and the bias potentials Vb(+) and Vb(−) are 4.3 volts and 0.7 volt, the upper and lower voltage margins are both 0.7 volt, whereas in the case of a driving at 1/365 duty, the bias potentials Vb(+) and Vb(−) are 4.0 volts and 1.0 volts, respectively, so that the upper and lower margins are both 1 volt. In view of the non-uniformity of the integrated circuit and the margin required for a fine voltage adjustment, while in the driving at 1/240 duty, the output is insufficient with the power supply potentials of 0 volt and 5 volts unless special measures are taken, in the driving at 1/365 duty, driving can be performed with a margin of at least 0.5 volts. Since the voltage margin increases as the number of time division increases, the voltage application method of the present invention is suitable for a high resolution liquid crystal display which requires a large number of electrodes.

As described previously, the voltages handled by the scanning circuit 2 and the voltages handled by the signal circuit 3 largely differ from each other. In such circuit structures, when the voltages are unevenly applied, the integrated circuits may be damaged or operate erroneously. In addition, a direct current may be applied to the liquid crystal cell. In this embodiment, to avoid these problems, the initiation and termination times of the output to the scanning circuit 2 from the power source circuit 4 which supplies the driving voltage and the potentials to be applied to the electrodes are adjusted. The output initiation time is adjusted so that one of the selecting potentials VS(+) and VS(−) is outputted first and the other is outputted after the driving voltage Vic has sufficiently increased. The output termination time is adjusted so that the selecting potentials VS(+) and VS(−) are substantially simultaneously discharged in a short period of time when the driving voltage Vic becomes lower than a predetermined value.

Specifically, as shown in FIG. 2, the power source circuit 4 is provided with a logic circuit 42, a transistor Tr and an attenuating circuit 45. The transistor Tr is connected to a terminal from which the selecting potential VS(+) of the DC—DC converter 41 is outputted, and outputs or intercepts the selecting potential VS(+) based on a control signal from the logic circuit 42. The logic circuit 42 monitors the difference between the selecting potential VS(−) and the potential VLog constituting the driving voltage Vic of the scanning circuit 2 and activates the transistor Tr when the difference becomes a predetermined value or higher. In this example, the predetermined voltage is set to 3 volts. Consequently, the voltages other than the driving voltage Vis for the signal circuit 3 and the negative selecting potential VS(−) are not generated until the driving voltage Vic of the scanning circuit 2 becomes 3 volts or higher (see FIG. 4), so that the positive selecting potential VS(+) is supplied to the scanning circuit 2 when the scanning circuit 2 can be stably driven. The generation of the potentials may be initiated by a control signal, e.g. the DISP-ON/OFF signal, supplied by the information processing apparatus. However, desired time adjustment is more surely made by initiating the potential generation based on the driving voltage Vic of the scanning circuit 2 like in this embodiment, since the stability of operation of the scanning circuit 2 can be directly sensed.

The attenuating circuit 45 short-circuits the selecting potentials VS(+) and VS(−) through a resistor R to set the potentials to the intermediate potential Vm. The logic circuit 42 activates the attenuating circuit 45 when the monitored driving voltage Vic becomes lower than 3 volts. As a result, as shown at the right end of FIG. 4, the selecting potentials VS(+) and VS(−) rapidly reaches the value (intermediate potential Vm) close to the ground potential.

Thus, by adjusting the time of supply of the selecting potential to the scanning circuit 2 both at the initiation and termination of the power supply to the liquid crystal display, the integrated circuit constituting the scanning circuit 2 is protected and its erroneous operation is prevented. In addition, the application of a direct current to the liquid crystal cell is prevented, so that the liquid crystal cell is also protected.

While in this embodiment, the positive selecting potential VS(+), the negative selecting potential VS(−) and the intermediate potential Vm are set to +32.5 volts, −27.5 volts and 2.5 volts, respectively, these potentials are not limited to these values but should be set in view of the characteristics of the liquid crystal used and the number of time division.

A second embodiment of the present invention will be described. The structure of this embodiment is substantially the same as that of the first embodiment and is different therefrom in the structure of the DC—DC converter of the power source circuit 4 and the structure of the initializing circuit of the receiving circuit 5. Hereinafter, the same portions and elements as those of the first embodiment are identified by the same reference designations and will not be described, and only the difference from the first embodiment will be described.

Figure 8:
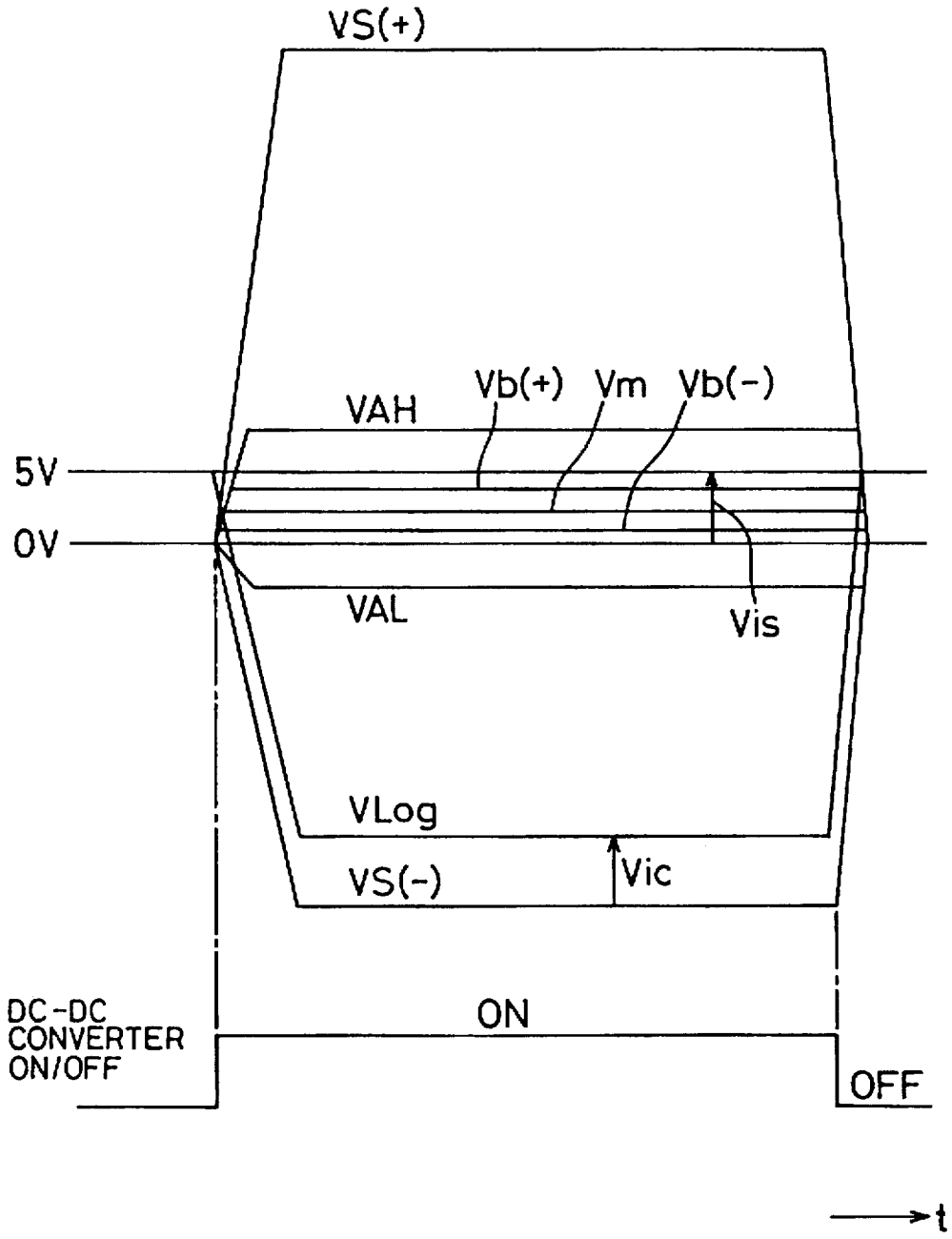
FIG. 8 shows application potentials and driving potentials generated by a power source circuit of the second embodiment.

Referring to FIG. 8, there is shown a relationship among potentials outputted by the power source circuit 4. The DC—DC converter 41*a* of this embodiment is supplied with a primary electric power consisting of a ground potential (0 volt) and a 5-volt potential, and generates the selecting potentials VS(+) and VS(−) to be applied to the scanning electrodes 11, the bias potentials Vb(+) and Vb(−) to be applied to the signal electrodes 12, and potentials VAH (7.5 volts) and VAL (−2.5 volts) for driving operational amplifiers and the like, using the ground potential (0 volt) of the primary power supply as origin. The DC—DC converter 41*a* generates the potential VLog, one of the potentials constituting the driving voltage Vic of the scanning circuit 2, using the 5-volt potential of the primary power supply as origin. The intermediate potential Vm to be applied to the scanning electrodes 11 is set to the median between the primary power supply potentials. The power source circuit 4 outputs the primary power supply potentials as the driving voltage Vis for the signal circuit 3.

Figure 7:
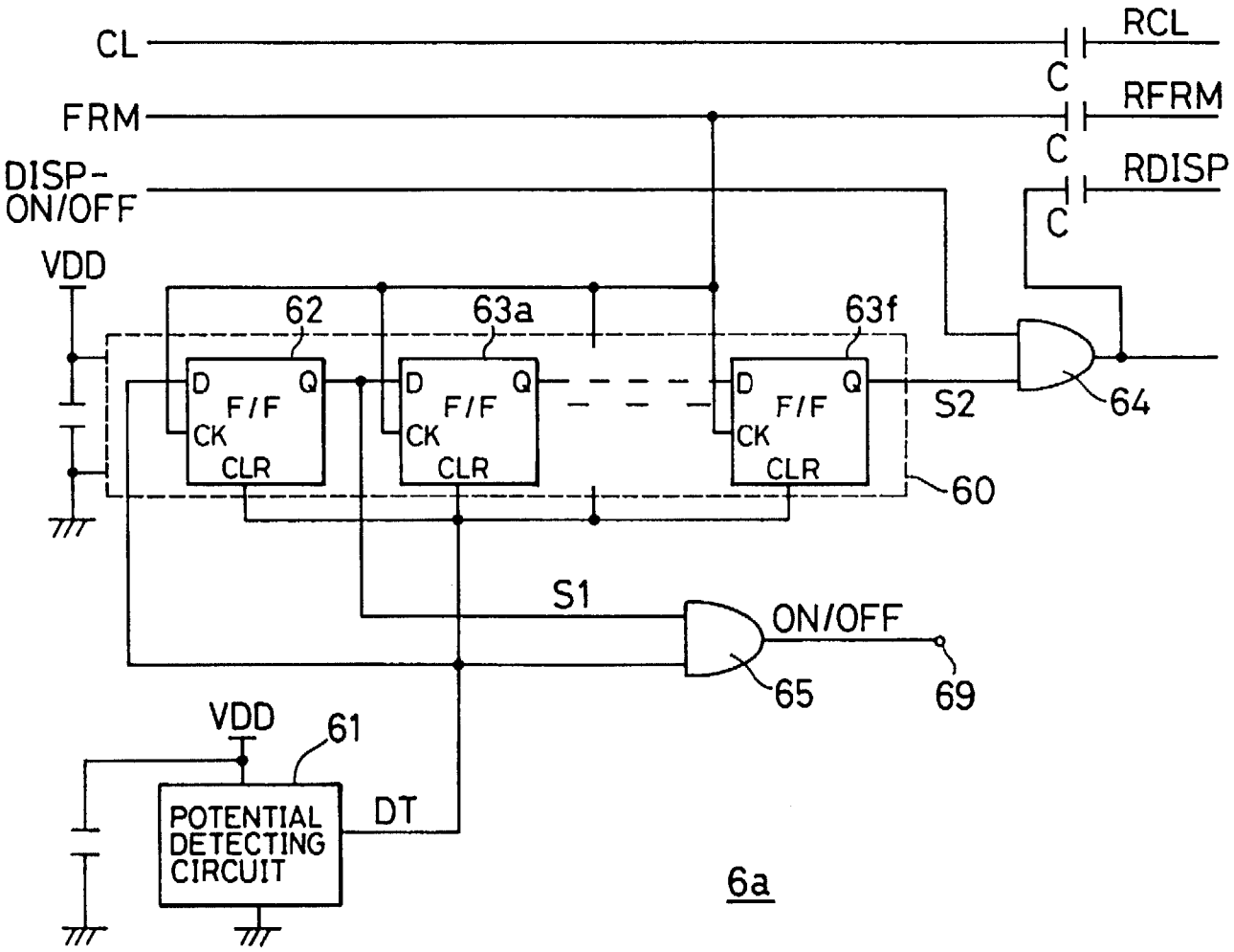
FIG. 7 shows the structure of an initializing circuit in a receiving circuit of a second embodiment of the present invention.

Referring to FIG. 7, there is shown the structure of the initializing circuit 6*a* of the receiving circuit 5. While the receiving circuit 5 includes two flip-flops in the first embodiment, seven flip-flops 62 and 63*a* to 63*f* are used in this embodiment to constitute a shift register 60. The potential detecting circuit 61 and the AND gates 64 and 65 are the same as those described previously. The potential detecting circuit 61 outputs the signal DT representing that the potential of the power supply has become 3 volts or higher. The AND gate 64 outputs a signal representative of a logical product of the DISP-ON/OFF signal supplied by the information processing apparatus and the output signal S2 of the last stage flip-flop 63*f*. The AND gate 65 outputs a signal representative of a logical product of the output signal DT of the potential detecting circuit 61 and the output signal S1 of the first stage flip-flop 62. The output signal of the AND gate 64 is supplied to the signal circuit 3 and to the scanning circuit 2 by way of the potential converting circuit 7 not shown in FIG. 7, and is used to control the initiation and termination of display of the liquid crystal cell 1. The output of the AND gate 65 is supplied to the power source circuit 4 and used to control the operation of the DC—DC converter 41*a*.

The output signal DT of the potential detecting circuit 61 is supplied to the clear terminals CLR of all the flip-flops and to the data input terminal D of the first stage flip-flop 62. The clock terminals CK of all the flip-flops are supplied with the frame signal FRM from the information processing apparatus. The data input terminals of the flip-flops 63*a* to 63*f* on the second and succeeding stages are each connected to the output terminal Q of the flip-flop on the preceding stage.

In this arrangement, when the frame signal FRM is supplied for the first time after the power supply has become 3 volts or higher, the potential generation by the DC—DC converter 41*a* is started based on the output of the AND gate 65. In addition, since the seven flip-flops are connected in series, the output of the AND gate 64 is held at a low level until the frame signal FRM is supplied seven times after the power supply has become 3 volts or higher, and thereafter, the level of the output becomes a level corresponding to the level of the inputted DISP-ON/OFF signal. Consequently, even if the DISP-ON/OFF signal is supplied by the information processing apparatus before the power is supplied to the liquid crystal display, the level transition of the DISP-ON/OFF signal is not transmitted to the scanning circuit 2 or the signal circuit 3 during a period corresponding to six frames, e.g. 48 msec when one frame period is 8 msec, after the power supply potential has become 3 volts or higher. Since the driving voltage Vic supplied from the DC—DC converter 41*a* to the scanning circuit 2 stabilizes in this period, the scanning circuit 2 hardly fails to detect the instruction to initiate display.

Figure 9:
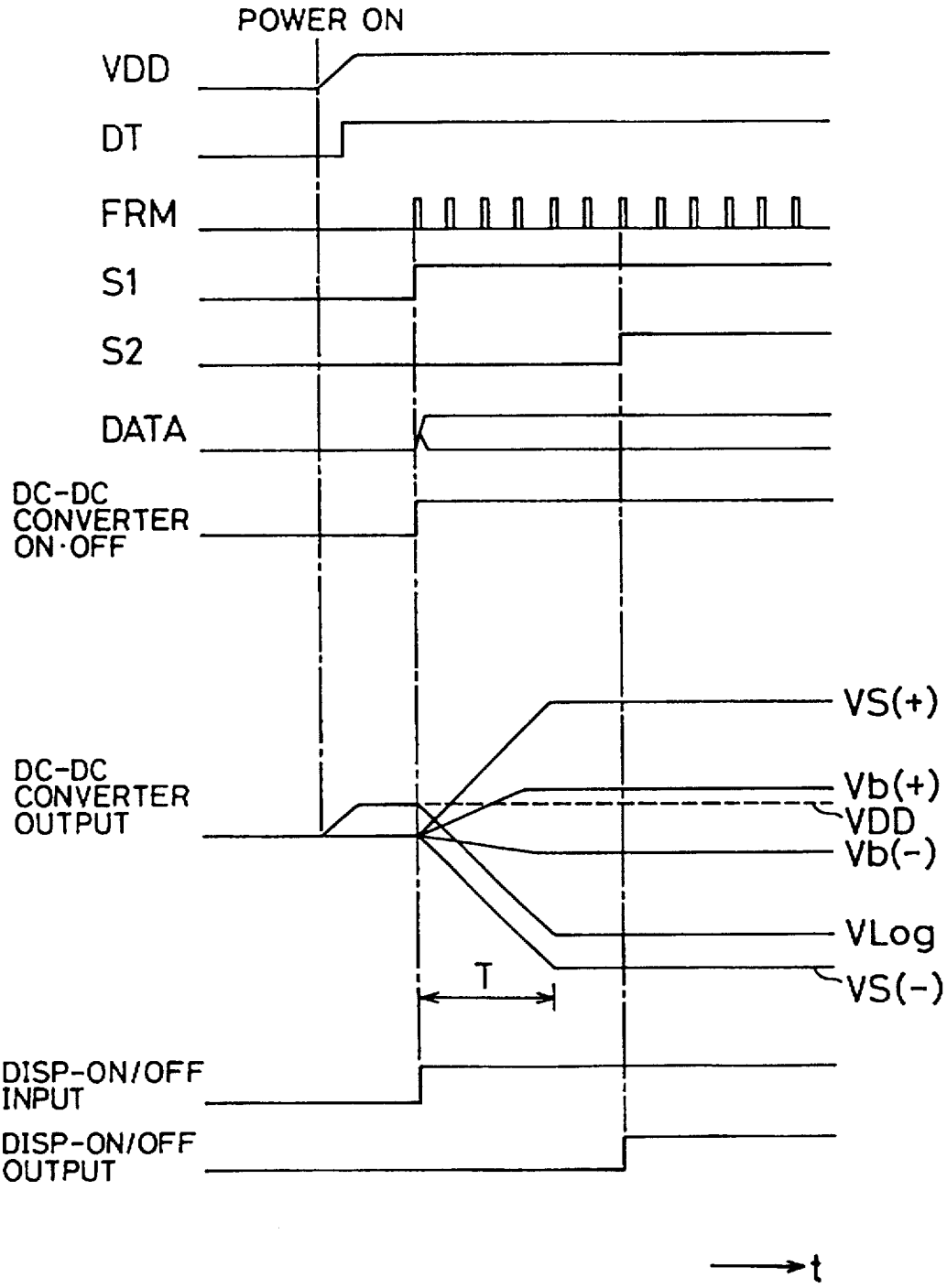
FIG. 9 shows a time relationship among control signals, the application potentials and the driving potentials of the second embodiment.

Referring to FIG. 9, there is shown a relationship among the variations of potentials and signals in this embodiment in the process of time. After a time T has elapsed which is necessary for the driving voltage Vic of the scanning circuit 2 and the potentials VS(+), VS(−), Vm, Vb(+) and Vb(−) to stabilize, the level transition of the DISP-ON/OFF signal is transmitted. Consequently, a problem is not caused that display is not provided although the display initiation instruction is supplied by the information processing apparatus. In addition, since the potentials to be applied have stabilized when the display is initiated, the phenomena are prevented that the display screen gradually brightens when the display is initiated and that striped patterns are generated in correspondence with the electrodes, so that a clear and high-definition image having a sufficient contrast is obtained from immediately after the initiation of the display.

Figure 10:
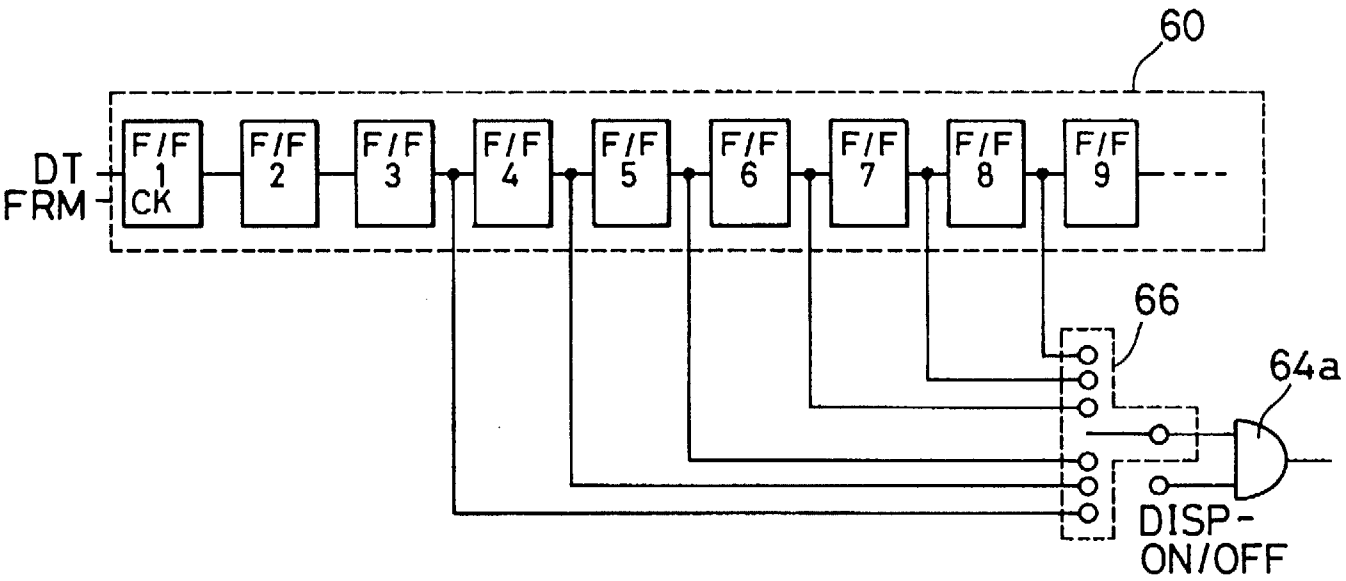
FIG. 10 shows another structure of the initializing circuit in the receiving circuit of the second embodiment.

While the delay of the display initiation time of the liquid crystal cell by the initializing circuit 6*a* is fixed in the above-described example, it may be adjustable. Referring to FIG. 10, there is shown an example of such an arrangement. In this example, a plurality of flip-flops are connected in series and a selecting means is provided which includes, for example, a rotary switch 66 having a plurality of input terminals. The outputs of the flip-flops on a predetermined stage and succeeding stages are supplied to the rotary switch 66, where one of the outputs is selected and inputted to the AND gate 64*a*. The AND gate 64*a* outputs a signal representative of a logical product of the signal from the rotary switch 66 and the DISP-ON/OFF signal. In this arrangement, the display initiation time is easily adjusted only by operating the rotary switch 66. For example, even when the power supply to the liquid crystal display is readily affected by peripheral devices and the time T varies which is necessary for the output potentials from the DC—DC converter 4 to stabilize, a display initiation time is set in accordance with the situation. In addition, adjustments made in manufacture, inspection and repair are facilitated. The liquid crystal display thus arranged is applicable to information processing apparatuses whose DISP-ON/OFF signals are outputted at different points of time, so that it can be incorporated in a variety of information processing apparatuses.

A third embodiment of the present invention will be described. The structure of this embodiment is substantially the same as that of the first embodiment and is different therefrom in the structures of the power source circuit 4 and the receiving circuit 5. In this embodiment, the scanning circuit 2 and the signal circuit 3 are both set to be driven by a voltage of 5 volts.

Figure 11:
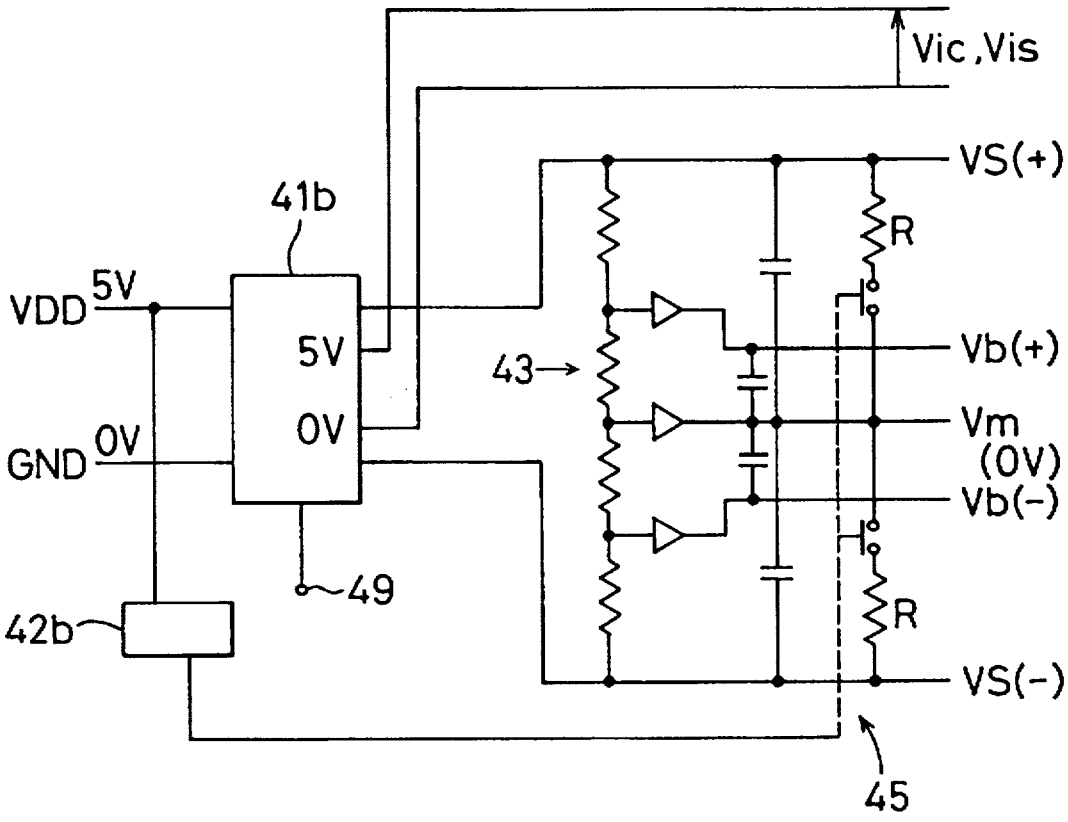
FIG. 11 shows the structure of a power source circuit of a third embodiment of the present invention.

Referring to FIG. 11, there is shown the structure of the power source circuit 4 of this embodiment. The power source circuit 4 is provided with a DC—DC converter 41*b* and a resistance dividing circuit 43. The power source circuit 4 is supplied with a pair of potentials, a ground potential (0 volt) and a potential VDD of 5 volts, as the primary electric power. The DC—DC converter 41*b* supplies these potentials of the primary power supply to the scanning circuit 2 and the signal circuit 3 as the driving voltages Vic and Vis. The DC—DC converter 41*b* generates and outputs the positive selecting potential VS(+) of +30 volts and the negative selecting potential VS(−) of −30 volts to be applied to the scanning electrodes 11.

The resistance dividing circuit 43 divides the selecting voltages VS(+) and VS(−) to generate the intermediate potential Vm which equals the ground potential as well as the two bias potentials Vb(+) and Vb(−) close to the ground potential and having the same absolute value. The potential Vm is applied to the scanning electrodes 11 and the potentials Vb(+) and Vb(−) are applied to the signal electrodes 12. The selecting voltages and the bias voltages are set based on the voltage averaging method. When the liquid crystal cell is driven at 1/240 duty, the bias potentials Vb(+) and Vb(−) are approximately +1.8 volts and −1.8 volts, respectively.

By setting the selecting potentials VS(+) and VS(−) and the bias potentials Vb(+) and Vb(−) to be symmetrical with respect to the intermediate potential Vm, the voltage applied to the liquid crystal cell 1 is prevented from being unbalanced, so that a high-definition image is displayed. In addition, by setting the intermediate potential Vm to the ground potential, the liquid crystal 1 is prevented from being charged after the termination of the display, so that the deterioration of the liquid crystal is prevented.

In the first embodiment, as shown in FIG. 2, the power source circuit 4 is provided with the transistor Tr. The driving voltage Vic of the scanning circuit 2 is monitored, and when the voltage becomes 3 volts or higher, the selecting potential VS(+) is outputted. This is because the driving voltage Vic of the scanning circuit 2 is constituted by the negative selecting potential VS(−) and the potential VLog generated separately therefrom and it requires some time for the driving voltage Vic to stabilize. On the contrary, the power source circuit 4 of the third embodiment is not provided with the transistor which delays the start of output of the selecting potential. This is because the supply of the driving voltage Vic to the scanning circuit is made faster by designing the DC—DC converter **41*b* to provide the primary power supply as the driving voltage Vic. When the selecting potentials VS(+) and VS(−) are supplied, the scanning circuit 2 is ready to operate stably. Therefore, it is very unlikely that the scanning circuit 2 is damaged and that an excessive voltage is applied to the liquid crystal cell 1**.

DC—DC converter **41*b* may be so designed that it generates the potentials of 0 volt and 5 volts from the primary power supply and provides them as the driving voltages Vic and Vis. In this case, it is preferable to use the transistor Tr as in the first embodiment, to monitor the driving voltage Vic of the scanning circuit 2 by the logic circuit 42*b*** and to output the selecting potential VS(+) after the voltage becomes 3 volts or higher.

The power source circuit 4 is provided with the logic circuit **42*b* which monitors the 5-volt potential of the primary power supply, and the attenuating circuit 45. The logic circuit 42*b* activates the attenuating circuit 45 when the primary power supply potential VDD becomes lower than 3 volts. The attenuating circuit 45 has the same structure as that of the first embodiment and short-circuits the selecting potentials VS(+) and VS(−) through the resistor R to set the potentials to the ground potential. Thereby, the scanning circuit 2 and the liquid crystal cell 1** are prevented from being damaged when the power supply to the liquid crystal display is stopped.

As the receiving circuit 5, the initializing circuit **6*a* of the second embodiment is used. In this embodiment, however, the potential converting circuit 7 which converts the potentials of the control signals is not used. This is because the driving voltage of the scanning circuit 2** is constituted by the ground potential and the 5-volt potential and set to substantially the same level as that of the potentials of the control signals supplied by the information processing apparatus.

Figure 12:
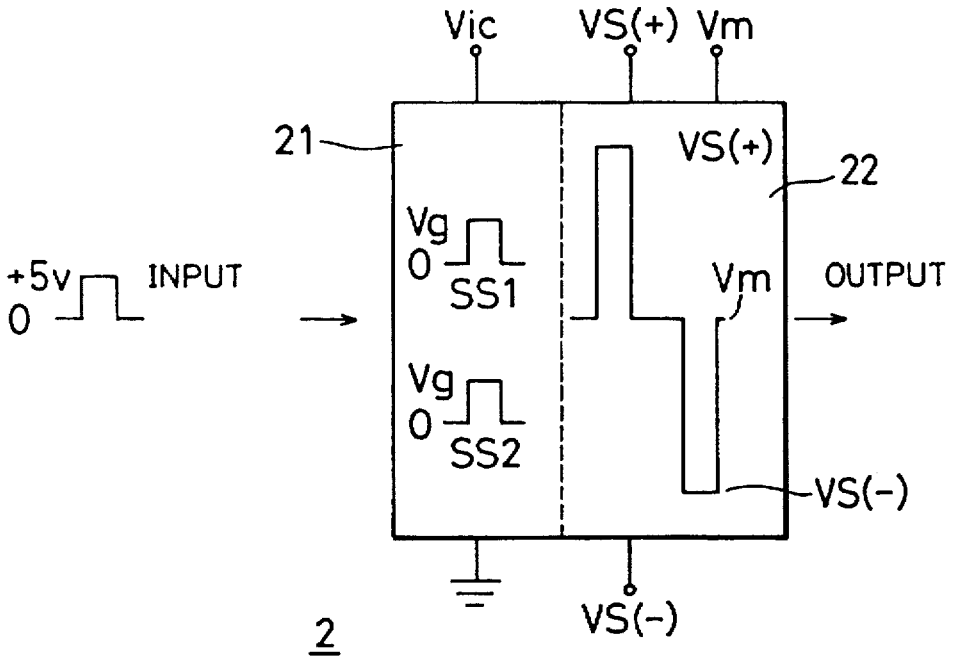
FIG. 12 shows an input potential and an output potential of a scanning circuit of the third embodiment.
Figure 13:
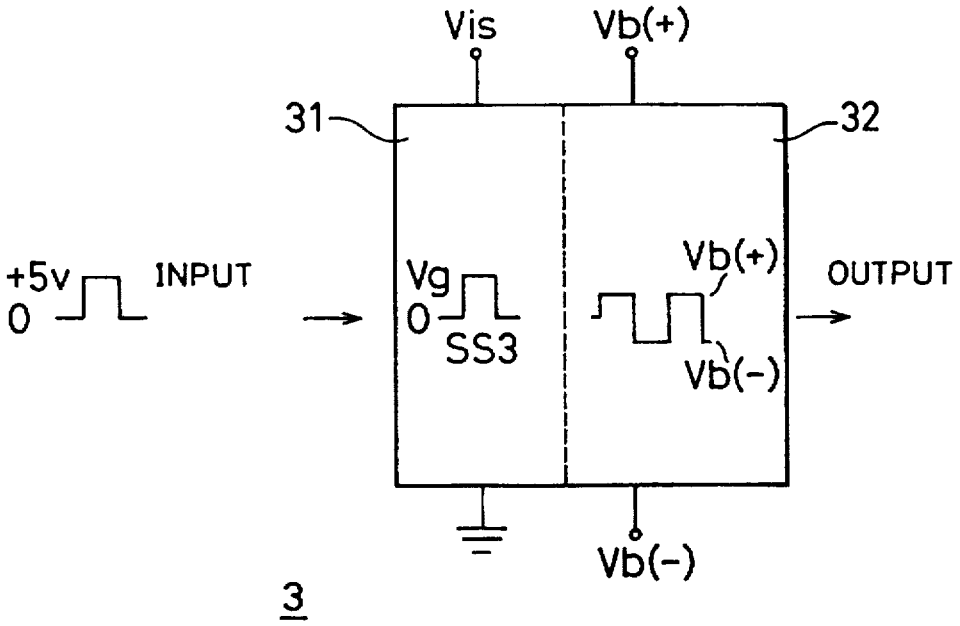
FIG. 13 shows an input potential and an output potential of a signal circuit of the third embodiment.

A relationship between the potentials of the input and output of the scanning circuit 2 and a relationship between the potentials of the input and output of the signal circuit 3 are shown in FIGS. 12 and 13, respectively. These circuits comprise logic portions 21 and 31 including shift registers and latches, and liquid crystal drivers 22 and 32 which output potentials to be supplied to the scanning electrodes 11 and the signal electrodes 12. The logic portions 21 and 31 process the control signals and the image signals supplied by the information processing apparatus to control the outputs from the liquid crystal drivers 22 and 32. The logic portion 21 of the scanning circuit 2 produces a control signal SS1 based on the alternating signal M and produces a control signal SS2 to instruct whether the selecting potential or the intermediate potential is outputted to individual scanning electrodes. The logic portion 31 of the signal circuit 3 produces a control signal SS3 to instruct whether a pixel is to be selected or not to be selected. Since the driving power of the logic portions 21 and 31 and the inputted signals have substantially the same potential level, it is unnecessary to convert the signal potentials at the logic portions 21 and 31. The control signals SS1, SS2 and SS3 all have two levels: the low level is 0 volt and the high level Vg is approximately 5 volts.

Figure 14:
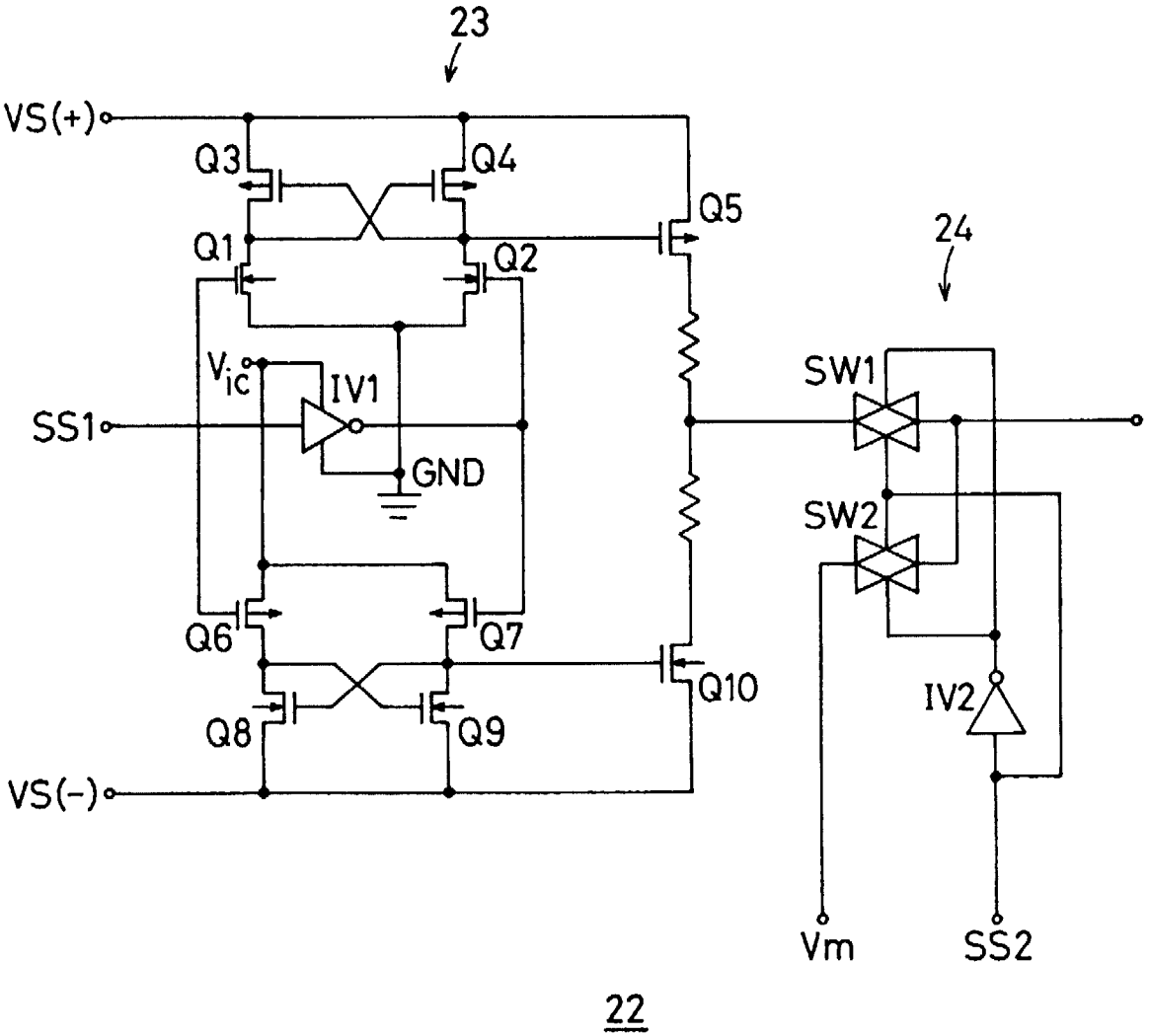
FIG. 14 shows the structure of a liquid crystal driver of the scanning circuit of the third embodiment.

Referring to FIG. 14, there is shown the structure of the liquid crystal driver 22 of the scanning circuit 2. The liquid crystal driver 22 includes a selecting potential changer 23 having an invertor IV1 and metal oxide semiconductor (MOS) transistors Q1 to Q10, and an application potential changer 24 including an invertor IV2 and analog switches SW1 and SW2. The selecting potential changer 23 is supplied with the positive and negative selecting potentials VS(+) and VS(−) generated by the power source circuit 4 and with the control signal SS1 produced by the logic portion 21. The application potential changer 24 is supplied with the intermediate potential Vm generated by the power source circuit 4, the output of the selecting potential changer 23 and the control signal SS2 produced by the logic portion 21.

An operation of the selecting potential changer 23 will be described. When the level of the control signal SS1 inputted is low, the level of output of the invertor IV1 is high, so that the N-channel transistor Q2 which receives the output of the invertor IV1 at its gate is activated. Consequently, the P-channel transistor Q5, which receives the ground potential at its gate, is activated. The P-channel transistor Q6, which receives a low level at its gate, is activated, so that the N-channel transistor Q9, which receives the 5-volt driving potential Vic at its gate, is activated. Consequently, the N-channel transistor Q10, whose gate is at the negative selecting potential VS(−), is not activated. While the transistor Q3 is activated and the transistors Q1, Q4, Q7 and Q8 are not activated during this period, this does not affect the activation of the transistors Q5 and Q10. Thus, when the level of the control signal SS1 is low, the selecting potential changer 23 outputs the positive selecting potential VS(+) from the transistor Q5.

On the other hand, when the level of the control signal SS1 inputted is high, the N-channel transistor Q1 is activated, so that the P-channel transistor Q4, whose gate is at the ground potential, is activated. Consequently, the P-channel transistor Q5, whose gate is at the positive selecting potential VS(+), is not activated. Since the level of output of the invertor IV1 is low, the P-channel transistor Q7 which receives the output at its gate is activated. As a result, the N-channel transistor Q10, whose gate is at 5 volts, is activated. While the transistor Q8 is activated and the transistors Q2, Q3, Q6 and Q9 are not activated during this period, this does not affect the activation of the transistors Q5 and Q10. Thus, when the level of the control signal SS1 is high, the selecting potential changer 23 outputs the negative selecting potential VS(−) from the transistor Q10.

As the analog switches SW1 and SW2 of the application potential changer 24, well known transmission gate circuits are used in which an N-channel MOS transistor and a P-channel MOS transistor are connected in parallel. The switches SW1 and SW2 are designed to operate exclusively of each other. Specifically, when the level of the control signal SS2 is high, the switch SW1 outputs the selecting potential supplied by the selecting potential changer 23, and when the level of the control signal SS2 is low, the switch SW2 outputs the intermediate potential Vm.

According to the above arrangement, any of the positive selecting potential VS(+), the negative selecting potential VS(−) and the intermediate potential Vm is applied to the scanning electrodes 11 of the liquid crystal cell 1. In this embodiment, the relationships among the voltages applied to the liquid crystal cell 1 are as shown in FIGS. 5 and 6.

Since the potentials for driving the scanning circuit 2 and the signal circuit 3 are set at the same level close to 0 volt in this embodiment, the structure of the power source circuit is simple and it is not necessary to convert the potentials of the control signals. The stability of operation of the scanning circuit 2 is also improved due to the fact that the signal circuit 2 comprises the logic portion 21 for processing the control signals from the information processing apparatus and the liquid crystal driver 22 for supplying the selecting potentials VS(+) and VS(−) to the scanning electrodes 11 and the selecting potentials VS(+) and VS(−) are not supplied to the logic portion 21.

Obviously, many modifications and variations of the present invention are possible in light of the above teachings. It is therefore to be understood that within the scope of the appended claims, the invention may be practiced other than as specifically described.

What is claimed is:

1. A liquid crystal display comprising:

a liquid crystal cell including a plurality of scanning electrodes arranged on a surface of a liquid crystal layer and a plurality of signal electrodes arranged on another surface of the liquid crystal layer in a direction perpendicular to a direction of the scanning electrodes;

a scanning circuit which is provided with a first potential and a second potential higher than the first potential, selects one out of the first potential and the second potential alternately and applies the selected potential to the scanning electrodes sequentially;

a signal circuit which is provided with a third potential and a fourth potential substantially intermediate between the first potential and the second potential and with an image signal and applies the third potential or the fourth potential to the signal electrodes according to the image signal; and a power source circuit which provides the scanning circuit with the first potential, the second potential and a driving power for the scanning circuit and provides the signal circuit with the third potential, the fourth potential and a driving power for the signal circuit, said power source circuit providing the scanning circuit with at least one of the first potential and the second potential after providing the driving power for the scanning circuit.

2. A liquid crystal display according to claim 1, wherein the power source circuit is supplied with a single pair of potentials and generates the first potential, the second potential, the third potential and the fourth potential from the single pair of potentials.

3. A liquid crystal display according to claim 2, wherein the power source circuit generates a fifth potential substantially intermediate between the first potential and the second potential from the first potential and the second potential and provides the scanning circuit with the fifth potential, and wherein the scanning circuit applies the fifth potential to the scanning electrodes other than the scanning electrode to which the selected potential is applied.

4. A liquid crystal display according to claim 3, wherein the fifth potential is at a ground level.

5. A liquid crystal display according to claim 3, wherein the power source circuit generates the third potential and the fourth potential from the first potential and the second potential.

6. A liquid crystal display according to claim 5, wherein a potential difference between the third potential and the fourth potential is equal to or smaller than a voltage of the driving power for the signal circuit.

7. A liquid crystal display according to claim 2, wherein the power source circuit starts to provide the scanning circuit with the second potential after a voltage of the driving power for the scanning circuit increases to a predetermined value or higher.

8. A liquid crystal display according to claim 2, wherein the power source circuit generates the first potential and the second potential from one of the pair of potentials supplied and generates a potential of the driving power for the scanning circuit from the other of the pair of potentials.

9. A liquid crystal display according to claim 2, wherein the power source circuit short-circuits the first potential and the second potential when a potential difference between the pair of potentials supplied becomes smaller than a predetermined value.

10. A liquid crystal display according to claim 2, wherein a number of the scanning electrodes is at least two hundred.

11. A liquid crystal display comprising:

a liquid crystal cell including a plurality of scanning electrodes arranged on a surface of a liquid crystal layer and a plurality of signal electrodes arranged on another surface of the liquid crystal layer;

a scanning circuit which is provided with a first potential and a second potential higher than the first potential, selects one out of the first potential and the second potential alternately and applies the selected potential to the scanning electrodes sequentially, said scanning circuit starting to apply the selected potential to the scanning electrodes after being supplied with a display initiation signal instructing to initiate display on the liquid crystal cell;

a signal circuit which is provided with a third potential and a fourth potential substantially intermediate between the first potential and the second potential and with an image signal and applies the third potential or the fourth potential to the signal electrodes according to the image signal; and a signal supplying circuit for supplying the scanning circuit with the display initiation signal.

12. A liquid crystal display according to claim 11, wherein the signal supplying circuit supplies the scanning circuit with the display initiation signal after a voltage for driving the scanning circuit increases to a predetermined value or higher.

13. A liquid crystal display according to claim 11, wherein the signal supplying circuit counts a number of frames of images to be displayed on the liquid crystal cell and supplies the scanning circuit with the display initiation signal after the number counted increases to a predetermined value or more.

14. A liquid crystal display according to claim 13, wherein the predetermined value is chosen from among a set of values.

15. A liquid crystal display according to claim 11, wherein a power source circuit is provided for generating a driving power for the scanning circuit, and wherein the signal supplying circuit supplies the scanning circuit with the display initiation signal after the driving power generated by the power source circuit becomes stable.

16. A liquid crystal display comprising:

a liquid crystal cell including a plurality of scanning electrodes arranged on a surface of a liquid crystal layer and a plurality of signal electrodes arranged on another surface of the liquid crystal layer;

a scanning circuit which is provided with a first potential and a second potential higher than the first potential, selects one out of the first potential and the second potential alternately and applies the selected potential to the scanning electrodes sequentially, said scanning circuit including a liquid crystal driver for selecting and outputting the first potential and the second potential to the scanning electrodes and a logic portion for controlling the liquid crystal driver in selecting and outputting the potentials, and the first potential and the second potential being provided only to the liquid crystal driver; and a signal circuit which is provided with a third potential and a fourth potential substantially intermediate between the first potential and the second potential and with an image signal and applies the third potential or the fourth potential to the signal electrodes according to the image signal.

17. A liquid crystal display according to claim 16, wherein the scanning circuit and the signal circuit are driven by a same power supply.

18. A liquid crystal display according to claim 16, wherein a power source circuit is provided for generating the first potential, the second potential, the third potential and the forth potential and for supplying the scanning circuit and the signal circuit with a driving power.

19. A liquid crystal display according to claim 16, wherein a signal supplying circuit is provided which counts a number of frames of images to be displayed on the liquid crystal cell and supplies the logic portion with a display initiation signal for instructing to initiate display on the liquid crystal cell when the number counted increases to a predetermined value or more, and wherein the logic portion instructs the liquid crystal driver to output the potential after being supplied with the display initiation signal.

* * * * *